United States Patent [19]

Lyman

[11] 4,375,117

[45] Mar. 1, 1983

[54] FLOOR CLEANER MOTOR MOUNT

[75] Inventor: John B. Lyman, Bloomington, Minn.

[73] Assignee: Whirlpool Corporation, Benton Harbor, Mich.

[21] Appl. No.: 210,039

[22] Filed: Nov. 24, 1980

[51] Int. Cl.[3] ..... A47L 9/22

[52] U.S. Cl. ..... 15/377; 15/389

[58] Field of Search ..... 15/412, 354, 389, 391, 15/368, 377

[56] References Cited

U.S. PATENT DOCUMENTS

| | | | |
|---|---|---|---|
| 1,247,732 | 11/1917 | Shelton . | |
| 1,266,318 | 5/1918 | Reynolds . | |
| 2,740,984 | 4/1956 | Holt | 15/361 |
| 2,997,730 | 8/1961 | Dierks | 15/368 |
| 3,184,775 | 5/1965 | Downey et al. | 15/377 X |
| 3,448,485 | 6/1969 | Wörwag | 15/391 X |
| 3,871,051 | 3/1975 | Collier | 15/368 X |

*Primary Examiner*—Chris K. Moore

*Attorney, Agent, or Firm*—Wegner, McCord, Wood & Dalton

[57] ABSTRACT

A floor cleaner motor mount wherein the motor is resiliently pivoted to provide the desired disposition of the belt in a cog drive belt extending between the motor and a rotatable brush of the cleaner located in a nozzle portion of the cleaner. The pivot axis is disposed so as to permit the axis of the motor shaft to be angularly adjusted relative to the axis of the brush. The pivot may be provided at one end of the motor housing. In the illustrated embodiment, the motor is adjustably positioned by a leaf spring acting against a base portion of the nozzle housing intermediate the pivot and drive connection.

15 Claims, 4 Drawing Figures

FIG. 1
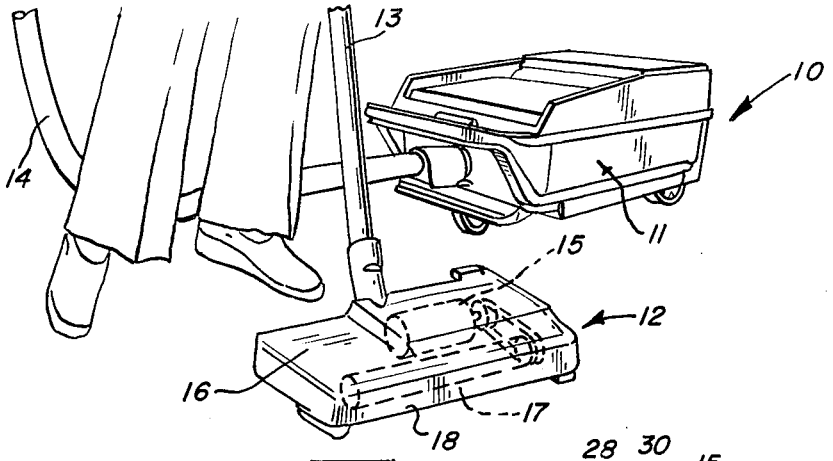
FIG. 2
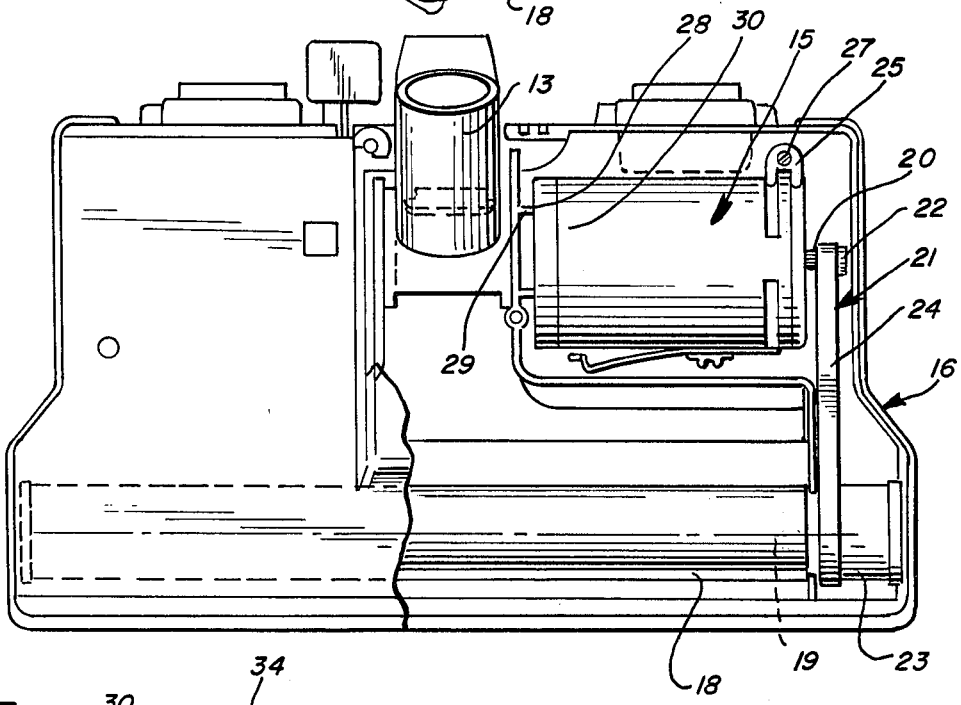
FIG. 3
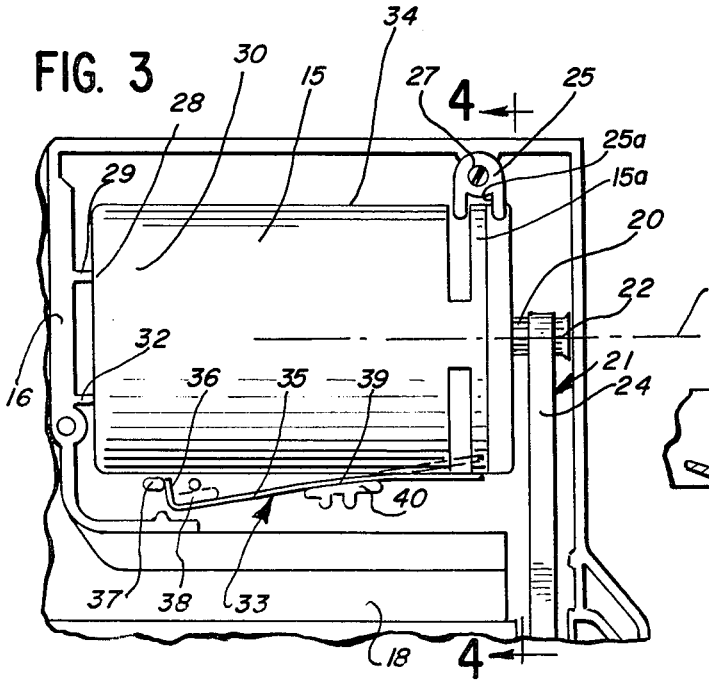
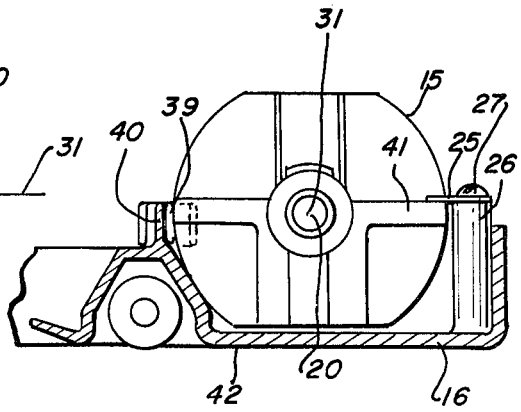
FIG. 4

FLOOR CLEANER MOTOR MOUNT

BACKGROUND OF THE INVENTION

1. Field of the Invention

This invention relates to floor cleaners and in particular to means for mounting the drive motor in a floor cleaner.

2. Description of the Background Art

In one form of a floor cleaner, a suction unit is provided having a wheeled housing in which is rotatably mounted a beater brush. The brush is driven from a drive motor carried in the housing by a drive means extending between the motor and the brush. It has been conventional to use flat drive belts in the drive between the motor and brush. It has further been conventional to adjust the tension in the belt by adjusting the position of the motor so as to move the motor shaft axis extending parallel to the brush axis toward and from the brush axis.

One form of surface treating machine having such a motor driven brush is illustrated in U.S. Pat. No. 2,740,984 of William E. Holt. As shown therein, the surface treating machine is provided with a drive motor connected to the brush by a drive belt. The motor is tiltably adjusted by means of a pivot pin extending parallel to the axis of the brush by turning a handwheel on a vertical adjusting screw. A spring coil opposes downward movement of the motor.

Another motor mount is illustrated in U.S. Pat. No. 1,247,732 of William G. Shelton. As shown therein, the motor pulley engages the drive wheel of the sewing machine. An optional spring pressure is applied through a leaf spring.

W. M. Reynolds shows, in U.S. Pat. No. 1,266,318, a fan belt tightener utilizing a leaf spring and a thumb screw in association with a bolt connected between the leaf spring and the fan shaft to move the fan shaft on a pivot extending axially parallel to the axis of the fan shaft.

SUMMARY OF THE INVENTION

The present invention comprehends an improved floor cleaner having means for pivotally mounting the brush motor for movement of the shaft axis thereof angularly adjustably relative to the axis of the brush.

More specifically, in the present invention, the motor support includes resilient biasing means for biasing the motor about a pivot axis extending transversely to the drive shaft axis of the motor.

In the illustrated embodiment, the biasing means comprises spring means, such as leaf spring means.

The leaf spring may have a fixed end and a distal end resiliently engaging the motor housing so as to act radially toward the shaft axis.

In the illustrated embodiment, the drive means comprises a belt drive means and, more specifically, comprises a cog belt drive means.

The pivot means mounts the motor in the illustrated embodiment to pivot about an axis at one end of the motor opposite the end to which the belt drive is connected.

In the illustrated embodiment, the pivot is defined by a portion of the nozzle housing of the cleaner. The spring means may be mounted to the nozzle housing and, more specifically, the housing may be provided with a mounting portion defining means for releasably retaining one end of the leaf spring.

The housing may further be provided with means for positioning the free end of the leaf spring in the desired biasing engagement with the motor housing.

The floor cleaner structure of the present invention is extremely simple and economical of construction while yet providing an improved motor mount and belt drive position control.

BRIEF DESCRIPTION OF THE DRAWING

Other features and advantages of the invention will be apparent from the following description taken in connection with the accompanying drawing wherein:

FIG. 1 is a fragmentary perspective view of a floor cleaner having a motor mount means embodying the invention;

FIG. 2 is a top plan view with portions broken away to illustrate in greater detail the arrangement of the brush and motor drive therein;

FIG. 3 is a further enlarged fragmentary horizontal section illustrating the motor mounting means of the invention; and FIG. 4 is a reduced vertical section taken substantially along the line 4—4 of FIG. 3.

DESCRIPTION OF THE PREFERRED EMBODIMENT

In the exemplary embodiment of the invention as disclosed in the drawing, a floor cleaner generally designated 10 is shown to comprise a canister 11 including a motor-fan unit and a powered floor cleaning attachment unit 12 having a handle 13 connected to the canister 11 by a suction hose 14. The hose may be provided with suitable electrical conductors for energizing an electric motor 15 mounted within the nozzle housing 16 of the floor cleaning unit 12.

The unit 12 includes a beater brush 17 rotatably mounted in a front portion 18 of the housing 16 for rotation about a brush axis 19 extending generally transversely of the housing, as see in FIG. 2.

Motor 15 is provided with a drive shaft 20 which drives a belt drive generally designated 21 for rotating the brush 18. As seen in FIG. 2, the belt drive includes a toothed pulley 22 on the motor shaft 20, a toothed pulley 23 at one end of the brush 18, and a cog belt 24 extending between pulleys 22 and 23 so as to drive pulley 23 as an incident of rotation of the motor shaft 20.

As seen in FIG. 4, motor 15 may be retained to a bottom wall or base portion 42 of housing 16 by a retainer plate 25 secured to the upper end of a post 26 formed on the base by a suitable screw 27.

As seen in FIG. 3, the retainer plate defines an opening **25*a* opening transversely to the axis 31 of drive shaft 20 and movably receives a portion of an end flange 15*a* of the motor to permit limited displacement of the motor thereby to retain the motor with the belt 24** properly positioned.

Motor 15 is adjustably positioned in housing 16 toward and from brush axis 19 so as to provide the proper adjustment in position for the belt 24. More specifically, the motor is pivotally mounted in the housing 16 for pivotal movement about a pivot axis 28 defined by a pivot portion 29 formed on the base of housing 16 at one end 30 of the motor. As can be seen in FIG. 3, pivot axis 28 is spaced laterally from the axis 31 of the motor shaft. As further shown in FIG. 3, housing 16 further defines a second mounting portion 32 formed on the base of motor end 30 in the original installation of the motor in the housing.

The invention comprehends adjustably positioning the motor about pivot axis 28 by means generally designated 33 acting against the housing 34 of the motor.

As shown in FIG. 3, the means for positioning the motor about the pivot axis 28, in the illustrated embodiment, comprises a somewhat "L" shaped leaf spring 35 having one end 36 corresponding to the foot of the "L" releasably secured to the housing 16 by a pair of mounting elements 37 and 38 formed on the base of the housing. End portion 36 defines a turned end of the spring and the distal end 39 of the spring is urged against the motor housing 34 by a third mounting portion 40 formed on the base of housing 16.

The spring is positioned between the mounting portions 37, 38 and 40 by insertion therebetween as illustrated in FIG. 3, so as to permit the free end 39 of the spring to bear resiliently against the housing and act in a direction radially of the drive shaft axis 31 away from the brush 18. Such biasing of the motor at the position intermediate end 30 and belt drive 21 causes the motor to pivot away from support 32 about axis 28 defined by the outer end of support 29 and, thus, adjust the position of the belt 24 so as to assure proper drive between the driver pulley 22 and driven pulley 23. As shown in FIG. 3, the motor is installed with the axis 31 generally parallel to the axis 19 of the brush. The biased pivoting of the motor about axis 28 is relatively small in making the desired position adjustment on the belt and, illustratively, may be in the order of approximately 1° from the parallel relationship of axis 31 and axis 19.

The motor is effectively retained in the adjusted position by the clamping plate 25 which is secured against a flange 41 on the motor after the motor is disposed in the spring-biased adjusted position of FIG. 2.

In the event the base of housing 16 bends or relaxes after a period of operation, the adjustment of the position of the motor and cog belt is readily remade by simply loosening the clamping plate 25 and allowing the spring to again adjust the pivotal position of the motor to a slightly greater angular disposition relative to the original parallel relationship with the brush axis. The invention, however, comprehends that the total pivotal angular adjustment is relatively small so that the belt drive remains generally aligned with the driven pulley 23 for proper engagement of the cog belt with the driven pulley as well as with the cog driver pulley 22.

The adjusting means of the present invention is extremely simple and economical of construction and may be readily installed in the assembly of the floor cleaning unit. As indicated above, readjustment of the belt may be readily effected by simply loosening and retightening the clamping plate 25 to maintain the desired belt position and toothed fit in the drive means.

The foregoing disclosure of specific embodiments is illustrative of the broad inventive concepts comprehended by the invention.

I claim:

1. In a floor cleaner having a brush and means for supporting the brush for rotation about a brush axis, the improvement comprising:

an electric motor having a housing and a drive shaft defining a drive shaft axis;

drive means for rotating the brush as an incident of rotation of the motor drive shaft;

means for mounting the motor to pivot about a pivot axis extending transversely of said drive shaft axis and resultingly dispose said motor shaft angularly relative to said brush axis; and means for adjustably pivoting the motor about said pivot axis.

2. The floor cleaner of claim 1 wherein said means for adjustably pivoting the motor comprises resilient biasing means.

3. The floor cleaner of claim 1 wherein said means for adjustably pivoting the motor comprises spring means.

4. The floor cleaner of claim 1 wherein said means for adjustably pivoting the motor comprises a leaf spring having a fixed end and a distal end resiliently engaging said motor housing.

5. The floor cleaner of claim 1 wherein said means for adjustably pivoting the motor comprises means acting radially toward said shaft axis.

6. The floor cleaner of claim 1 wherein said means for adjustably pivoting the motor comprises a leaf spring having a fixed end and a distal end acting radially toward said shaft axis against said motor housing.

7. In a floor cleaner having a brush and means for supporting the brush for rotation about a brush axis, the improvement comprising:

an electric motor having a housing defining an end flange, and a drive shaft defining an axis generally parallel to said brush axis;

belt drive means extending between said shaft and brush for rotating the brush as an incident of rotation of the motor drive shaft;

means for mounting the motor to pivot about a pivot axis spaced from said end flange;

spring means for adjustably pivoting the motor about said pivot axis to properly position said belt drive means; and a retainer carried by the housing defining an opening opening transversely to said drive shaft axis and movably receiving said end flange to permit limited pivotal and axial displacement of the motor thereby to retain the motor with the belt drive properly positioned.

8. In a floor cleaner having a brush and means for supporting the brush for rotation about a brush axis, the improvement comprising:

an electric motor having a housing and a drive shaft;

belt drive means extending between said shaft and brush for rotating the brush as an incident of rotation of the motor driven shaft;

means for mounting the motor to pivot about a pivot axis; and spring means for adjustably pivoting the motor about said pivot axis to properly position said belt drive means, said mounting means comprising means for mounting the motor to pivot about an axis at one end of the motor.

9. The floor cleaner of claim 8 wherein said pivot axis is at the end of the motor spaced from the belt drive means.

10. The floor cleaner of claim 7 wherein said cleaner includes a nozzle housing having a pivot portion engaged by said motor and defining said pivot axis.

11. In a floor cleaner having a brush and means for supporting the brush for rotation about a brush axis, the improvement comprising:

an electric motor having a housing and a drive shaft;

belt drive means extending between said shaft and brush for rotating the brush as an incident of rotation of the motor drive shaft;

means for mounting the motor to pivot about a pivot axis; and spring means for adjustably pivoting the motor about said pivot axis to properly position said belt drive means, said cleaner including a nozzle housing having a pivot portion engaged by one end of said motor and defining said pivot axis.

12. The floor cleaner of claim 7 wherein said cleaner includes a nozzle housing having a mounting portion removably engaged by said spring means for positioning said spring means in biasing engagement with said motor housing.

13. In a floor cleaner having a brush and means for supporting the brush for rotation about a brush axis, the improvement comprising:

an electric motor having a housing and a drive shaft;

belt drive means extending between said shaft and brush for rotating the brush as an incident of rotation of the motor drive shaft;

means for mounting the motor to pivot about a pivot axis; and spring means for adjustably pivoting the motor about said pivot axis to properly position said belt drive means, said cleaner including a nozzle housing having a mounting portion removably engaged by said spring means for positioning said spring means in biasing engagement with said motor housing, said spring means comprising a leaf spring and said mounting portion defining means for releasably retaining one end of the leaf spring.

14. The floor cleaner of claim 13 further including means for positioning the free end of the leaf spring in said biasing engagement with the motor housing.

15. The floor cleaner of claim 7 wherein said belt drive means comprises a cog belt drive means.

* * * * *